US006579071B1

(12) United States Patent
Tarutani et al.

(10) Patent No.: US 6,579,071 B1
(45) Date of Patent: Jun. 17, 2003

(54) STRUCTURE FOR SUPPRESSING PULSATION IN COMPRESSOR

(75) Inventors: Tomoji Tarutani, Kariya (JP); Naofumi Kimura, Kariya (JP); Toshihiro Kawai, Kariya (JP); Masahiro Kawaguchi, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/868,388

(22) PCT Filed: Oct. 18, 2000

(86) PCT No.: PCT/JP00/07236

§ 371 (c)(1),
(2), (4) Date: Jun. 18, 2001

(87) PCT Pub. No.: WO01/29418

PCT Pub. Date: Apr. 26, 2001

(30) Foreign Application Priority Data

Oct. 20, 1999 (JP) ..... 11-298734

(51) Int. Cl.[7] ..... F04B 1/12; F04B 27/08

(52) U.S. Cl. ..... 417/269; 417/312; 417/540; 181/403

(58) Field of Search ..... 417/269, 312, 417/313, 222.1, 222.2, 540, 541, 542; 91/499, 474; 181/403

(56) References Cited

U.S. PATENT DOCUMENTS 4,583,922 A * 4/1986 Iijima et al. ..... 417/269
4,761,119 A * 8/1988 Nomura et al. ..... 417/269
5,556,260 A * 9/1996 Takenaka et al. ..... 417/269
5,556,265 A 9/1996 Michiyuki et al. ..... 417/312
5,674,054 A * 10/1997 Ota et al. ..... 417/269
5,782,614 A * 7/1998 Shimizu et al. ..... 417/269
6,045,342 A * 4/2000 Kimura ..... 417/540

FOREIGN PATENT DOCUMENTS

JP 65-56583 4/1989 ..... F04B/39/00
JP 6-317249 11/1994 ..... F04B/27/08
JP 7-269462 10/1995 ..... F04B/27/08
JP 8-105381 4/1996 ..... F04B/27/08

* cited by examiner

*Primary Examiner*—Charles G. Freay
*Assistant Examiner*—Han L. Liu
(74) *Attorney, Agent, or Firm*—Morgan & Finnegan, LL

(57) ABSTRACT

An introduction passage is formed in a rear housing. The introduction passage extends from a wall of the rear housing across a discharge chamber to a suction chamber. The introduction passage has a first portion extending from an opening portion of the rear housing along a wall of the discharge chamber and along a wall of the suction chamber to the suction chamber. A second portion of the passage bends in the suction chamber substantially perpendicularly and then extends toward a valve plate of a compressor. The outlet of the introduction passage is located closer to the valve plate than to the wall of the suction chamber. Therefore, generation of suction pulsation is suppressed without increasing the size of the compressor.

23 Claims, 5 Drawing Sheets

STRUCTURE FOR SUPPRESSING PULSATION IN COMPRESSOR

BACKGROUND OF THE INVENTION

The present invention relates to structures for suppressing pulsation in compressors in which gas flows from a suction chamber into a cylinder bore by reciprocation of a piston.

In general, a suction port and a discharge port are formed in a valve plate provided in a compressor. Opposed to the suction port and the discharge port, respectively, a suction valve and a discharge valve are provided so that they can be opened and closed. With reciprocation of a piston, gas is drawn through the suction port into the cylinder bore by forcing the suction valve to open. In this kind of compressor, the pressure in the suction chamber may vary periodically upon compression due to opening of the suction valve and vibration, and so-called suction pulsation may occur.

The larger the volume of the suction chamber in the compressor is, the more such suction pulsation is suppressed. Japanese Unexamined Patent Publication No. Hei 7-269462 discloses a compressor in which an auxiliary suction chamber is provided to expand the suction chamber. Such an expanded suction chamber further improves the suppression of suction pulsation.

To expand the suction chamber, the auxiliary suction chamber is provided on an extension of the axial line of a rotary shaft. Therefore, a space for the auxiliary suction chamber is required within the cylinder block. As a result, the length of the cylinder block increases, and the size of the compressor increases. In case of a compressor incorporated in a vehicle, an increase in size of the compressor may bring cause interference with parts of the vehicle other than the compressor, which is undesirable.

BRIEF SUMMARY OF THE INVENTION

It is an object of the present invention to provide a compressor with improved pulsation suppression, however, the compressor is not enlarged.

In order to attain the above object, the present invention present invention provides a compressor as described below. That is, the compressor includes a housing having an opening portion and a cylinder block. A rotary shaft is supported by the housing. A plurality of cylinder bores are provided in the cylinder block around the axis of the rotary shaft. A discharge chamber and a suction chamber are formed in the housing. A valve plate separates each cylinder bore from the suction chamber and the discharge chamber. A plurality of discharge ports and a plurality of suction ports corresponding to the respective cylinder bores are formed in the valve plate. A piston accommodated in each cylinder bore compresses gas drawn into the cylinder bore through the corresponding suction port. The compressed gas is discharged from the cylinder bore into the discharge chamber through the corresponding discharge port. An introduction passage extends from the opening portion toward the suction chamber and then bends and further extends toward the valve plate. The introduction passage connects the opening portion of the housing with the suction chamber to allow gas to flow therethrough.

DETAILED DESCRIPTION OF THE PREFERRED EMBODIMENTS

Hereinafter, the first embodiment, which is a variable displacement type compressor incorporated in a vehicle, will be described on the basis of FIGS. 1 to 3.

Figure 1:
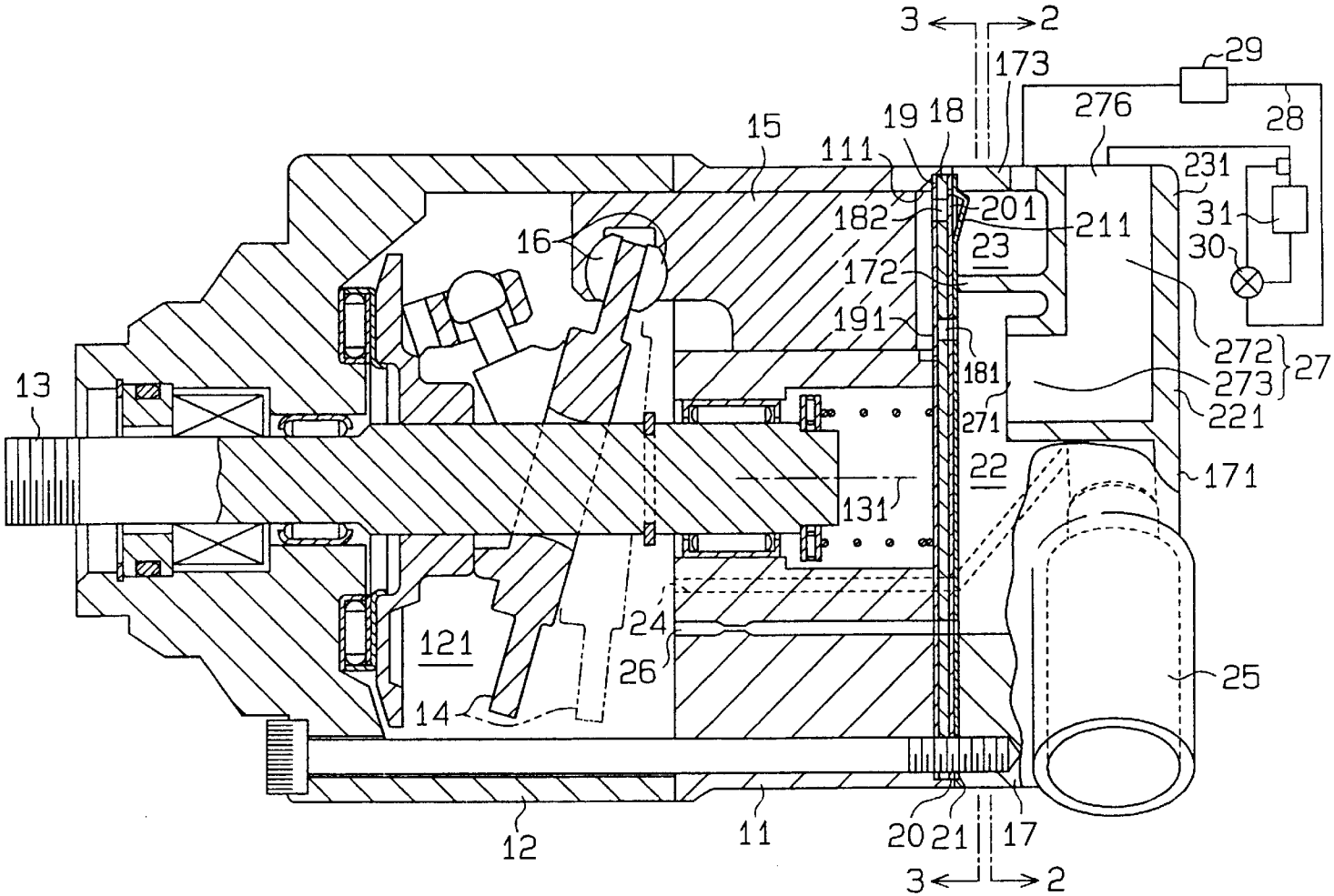
FIG. 1 is a sectional view of a compressor according to the first embodiment of the present invention.
Figure 2:
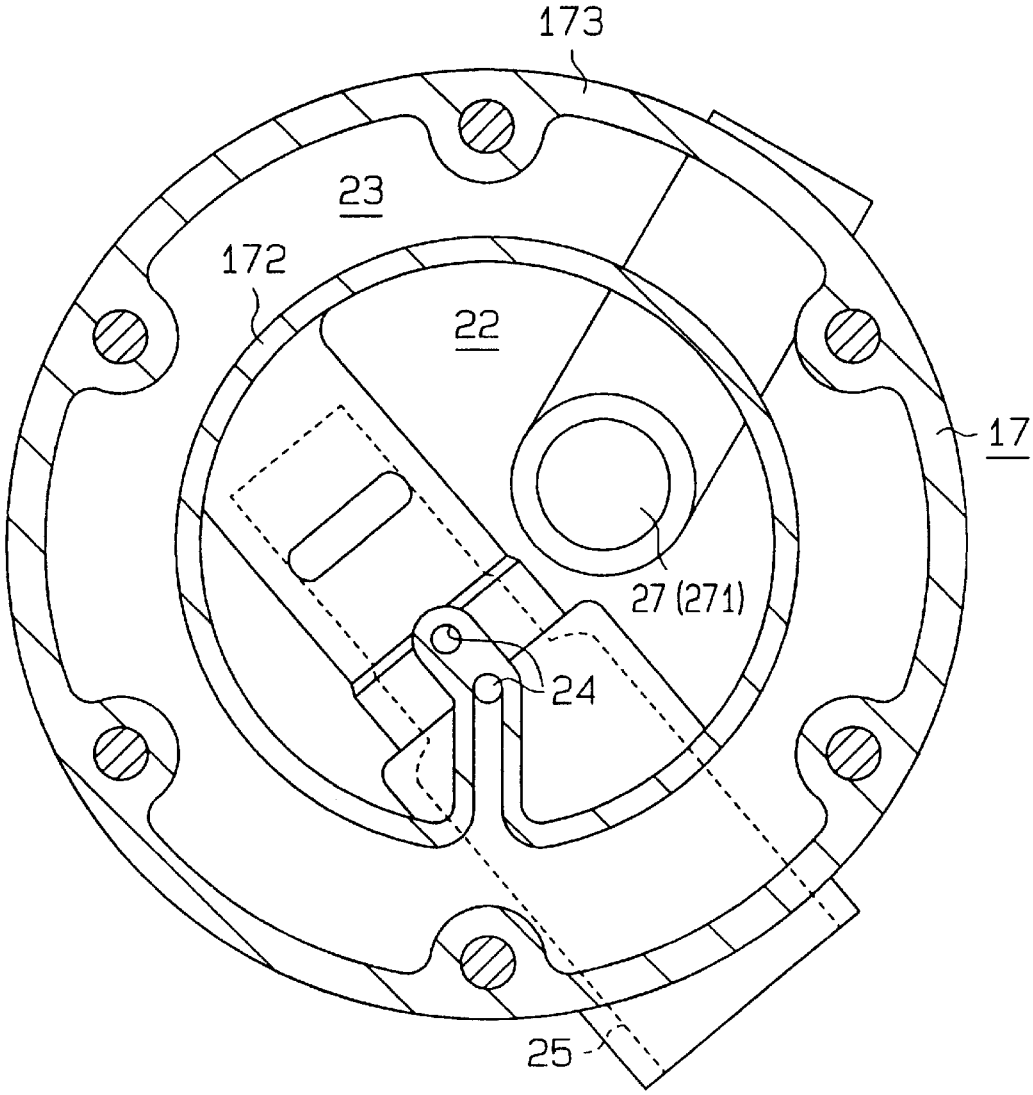
FIG. 2 is a sectional view taken along the line 2—2 in FIG. 1.

As shown in FIG. 1, a control pressure chamber 121 is formed between a cylinder block 11 and a front housing 12. A rotary shaft 13 supported by the cylinder block 11 and the front housing 12 is coupled with an engine (not shown). A swash plate 14 inclines relative to the rotary shaft 13 and rotates together with the rotary shaft 13. A plurality of cylinder bores 111 (only one is shown in FIG. 1) are formed in the cylinder block 11 to extend through the cylinder block 11. The cylinder bores 111 are provided at constant angular intervals on a circle, the center of which lies on the axis 131 of the rotary shaft 13. A piston 15 is accommodated in each cylinder bore 111. Rotation of the swash plate 14 is converted into reciprocation of each piston 15 through shoes 16.

A rear housing 17 is joined with the cylinder block 11 through a valve plate 18, first and second plates 19 and 20, and a retainer plate 21. A suction chamber 22 and a discharge chamber 23 are defined in the rear housing 17. As shown in FIGS. 2 and 3, the suction chamber 22 and the discharge chamber 23 are separated from each other by an annular partition 172 formed in the rear housing 17. The discharge chamber 23 surrounds the suction chamber 22.

Figure 3:
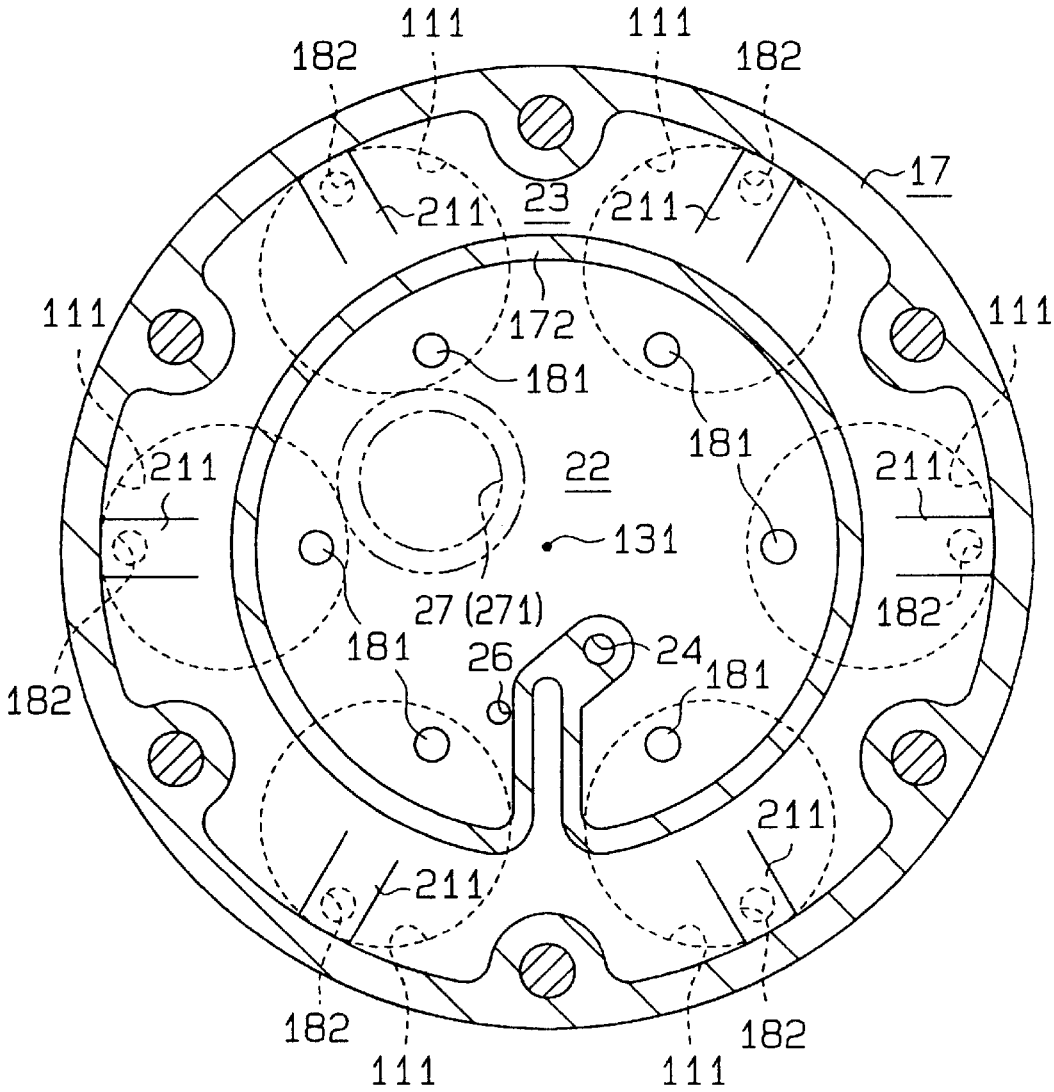
FIG. 3 is a sectional view taken along the line 3—3 in FIG. 1.

As shown in FIGS. 1 and 3, radially inside the partition 172, a suction port 181 is formed in the retainer plate 21, the second plate 20, and the valve plate 18 to correspond to each cylinder bore 111. The suction ports 181 are arranged at constant angular intervals on a circle, the center of which lies on the axis 131 of the rotary shaft 13. Radially outside the partition 172, a discharge port 182 is formed in the first plate 19 and the valve plate 18 to correspond to each cylinder bore 111. A suction valve 191 corresponding to each suction port 181 is formed in the first plate 19, and a discharge valve 201 corresponding to each discharge port 182 is formed in the second plate 20. The suction valve 191 opens and closes the suction port 181, and the discharge valve 201 opens and closes the discharge port 182.

A pressure supply passage 24 connects the discharge chamber 23 with the control pressure chamber 121. A bleed passage 26 connects the control pressure chamber 121 with the suction chamber 22. A displacement control valve 25 is provided in the pressure supply passage 24. The pressure supply passage 24 is for supplying gas in from the discharge chamber 23 to the control pressure chamber 121. A controller controls magnetization/demagnetization of the displacement control valve 25 on the basis of the temperature detected by a temperature detector (not shown) for detecting the temperature in a vehicular compartment, and based on an objective temperature set by a room temperature setter (not shown).

Gas in the control pressure chamber 121 flows out through bleed passage 26 into the suction chamber 22. When the displacement control valve 25 is in a demagnetized state, gas in the discharge chamber 23 can not flow into the control pressure chamber 121. Therefore, the differential pressure, with respect to a piston 15, between the pressure in the control pressure chamber 121 (control pressure) and the suction pressure decreases, and the swash plate 14 moves to the maximum inclination angle position, which is shown by a solid line in FIG. 1. When the displacement control valve 25 is in a magnetized state, gas in the discharge chamber 23 flows into the control pressure chamber 121 through the pressure supply passage 24. Therefore, the differential pressure, with respect to a piston 15, between the control pressure and the suction pressure increases, and the swash plate 14 moves to the minimum inclination angle position, which is shown by a dotted line in FIG. 1.

An introduction passage 27 is formed in the rear housing 17. An inlet 276 of the introduction passage 27 is formed in the peripheral wall 173 of the rear housing 17. The introduction passage 27 extends from the inlet 276 across the discharge chamber 23 to communicate with the suction chamber 22. The introduction passage 27 is isolated from the discharge chamber 23 by a wall of the introduction passage 27. The introduction passage 27 has a first portion 272 extending into the suction chamber 22 along an end wall 231 of the discharge chamber 23 and an end wall 221 of the suction chamber 22, and a second portion 273 that bends in the suction chamber 22 at a substantial right angle and extends toward the valve plate 18. The first portion 272 is substantially perpendicular to the axis 131 of the rotary shaft 13, and the second portion 273 is parallel with the axis 131 of the rotary shaft 13. Both the end walls 221 and 231 of the suction chamber 22 and the discharge chamber 23 are opposed to the valve plate 18.

The outlet 271 of the introduction passage 27 is located at a position closer to the valve plate 18 than the end wall 221 of the suction chamber 22.

When the piston 15 moves from its top dead center to its bottom dead center, gas in the suction chamber 22 is drawn through the corresponding suction port 181 into the corresponding cylinder bore 111 while pushing away the corresponding suction valve 191. When the piston 15 moves from its bottom dead center to its top dead center, gas in the cylinder bore 111 is discharged through the corresponding discharge port 182 into the discharge chamber 23 while pushing away the corresponding discharge valve 201. The degree of opening of the discharge valve 201 is regulated by a retainer 211 on the retainer plate 21. Gas in the discharge chamber 23 returns to the suction chamber 22 via a condenser 29, an expansion valve 30, and an evaporator 31 on an external gas circuit 28, and the introduction passage 27.

This embodiment has the following effects.

Fluctuation of the suction pressure in the vicinity of the outlet 271 is propagated as suction pulsation through the introduction passage 27 to the external gas circuit 28. The suction pulsation causes vibration of the evaporator 31 in the vehicular compartment to generate noise. On the contrary, in this embodiment, because the introduction passage 27 is bent, the generation of the suction pulsation and the noise is suppressed. In addition, the introduction passage 27 can be formed in the rear housing 17 without causing increasing the size of the rear housing 17 along the axis 131 of the rotary shaft 13. Therefore, the compressor is not enlarged.

The introduction passage 27 has a pulsation suppressing effect due to its throttle function. The longer the introduction passage 27 is, the greater the throttle function is. By bending the introduction passage 27, the introduction passage 27 is extended, and the effect of suppressing the suction pulsation is improved.

By forming a right angle in the introduction passage 27, when the rear housing 17 is formed using a mold, drawing out of the mold is simplified.

In general, the pressure vibration in the suction chamber 22 is less in the vicinity of the valve plate 18 than in the vicinity of the end wall 221, except in the vicinity of the suction port 181. The outlet 271 of the introduction passage 27 is located closer to the valve plate 18 than to the end wall 221 of the suction chamber 22. Therefore, the suction pulsation is effectively suppressed.

The entire length of the introduction passage 27 is the sum of the length of the first portion 272 and the length of the second portion 273. The first portion 272 is a suitable portion for elongating the introduction passage 27 without increasing the length of the rear housing 17 along the axis of the rotary shaft 13. Therefore, the introduction passage 27, which passes through able discharge chamber 23, is advantageous for suppressing suction pulsation.

By forming the first portion 272 of the introduction passage 27 to extend along the end wall 231, the end wall 231 serves as part of the wall of the introduction passage 27. If the first portion 272 is formed separately from the end wall 231, the occupancy space taken by the wall of the introduction passage 27 in the discharge chamber 23 is more than that in this embodiment, and so the volume of the discharge chamber 23 is less than that in this embodiment. The greater the volume of the discharge chamber 23 is, the higher the effect of suppressing discharge pulsation is. Besides, by forming the introduction passage 27 to extend along the end wall 231 of the discharge chamber 23 and the end wall 221 of the suction chamber 22, the length of the portion 273 of the introduction passage 27 toward the valve plate 18 can be ensured at the maximum.

By forming the portion of the introduction passage 27 extending radially of the rotary shaft 13 (i.e., radially of the rear housing 17), integrally with the end wall 221 of the suction chamber 22 and the end wall 231 of the discharge chamber 23, they can be manufactured more easily in comparison with a case where they are formed separately, and the cost can be reduced.

Figure 4:
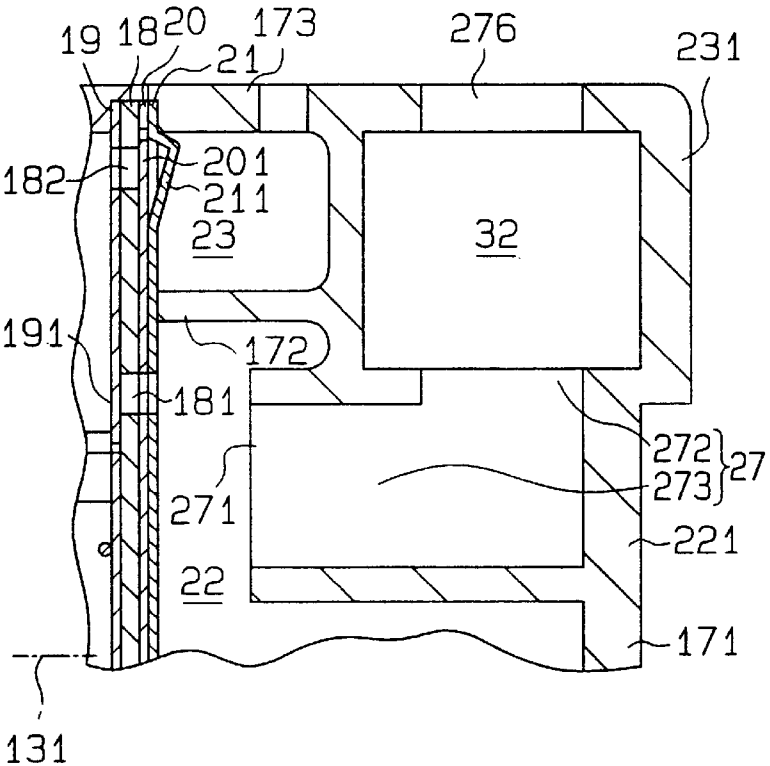
FIG. 4 is an enlarged partial sectional view in the vicinity of a suction chamber according to the second embodiment.

Next, the second embodiment shown in FIG. 4 will be described. Parts that are the same as those in the first embodiment shown in FIGS. 1 to 3 are denoted by the same reference numerals used in the first embodiment.

An auxiliary suction chamber 32 is provided in the middle of the introduction passage 27. The auxiliary suction chamber 32 extends parallel to the valve plate 18. The auxiliary suction chamber 32 increases the volume of the introduction passage 27. Most of the auxiliary suction chamber 32 extends through the discharge chamber 23. The auxiliary suction chamber 32 effectively reduces suction pulsation.

Figure 5:
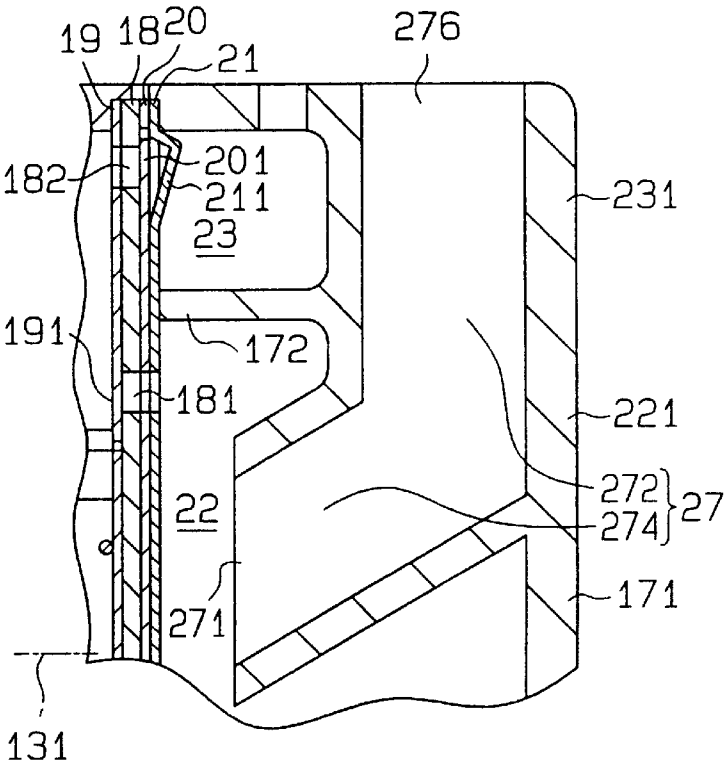
FIG. 5 is an enlarged partial sectional view in the vicinity of a suction chamber according to the third embodiment.

Next, a third embodiment, which is shown in FIG. 5, will be described. Parts that are the same as those in the first embodiment shown in FIGS. 1 to 3 are denoted by the same reference numerals used in the first embodiment.

A portion 274 of the introduction passage 27, that extends toward the valve plate 18 is inclined relative to the axis 131 of the rotary shaft 13. The inclination of the portion 274 of the introduction passage 27 increases the length of the introduction passage 27. As a result, suction pulsation is reduced.

Figure 6:
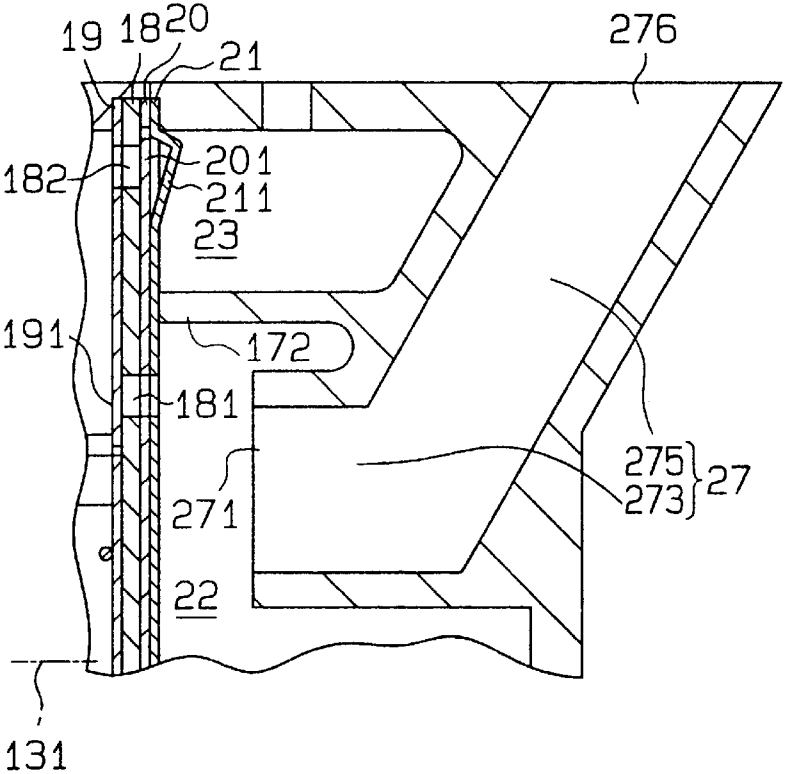
FIG. 6 is an enlarged partial sectional view in the vicinity of a suction chamber according to the fourth embodiment.

Next, a fourth embodiment, which is shown in FIG. 6, will be described. Parts that are the same as those in the first embodiment of FIGS. 1 to 3 are denoted by the same reference numerals used in the first embodiment.

A portion 275 of the introduction passage 27 extending from the inlet 276 through the discharge chamber 23 into the suction chamber 22 is inclined relative to the axis 131 of the rotary shaft 13. The inclined portion 275 of the introduction passage 27 increases the length of the introduction passage 27.

Figure 7:
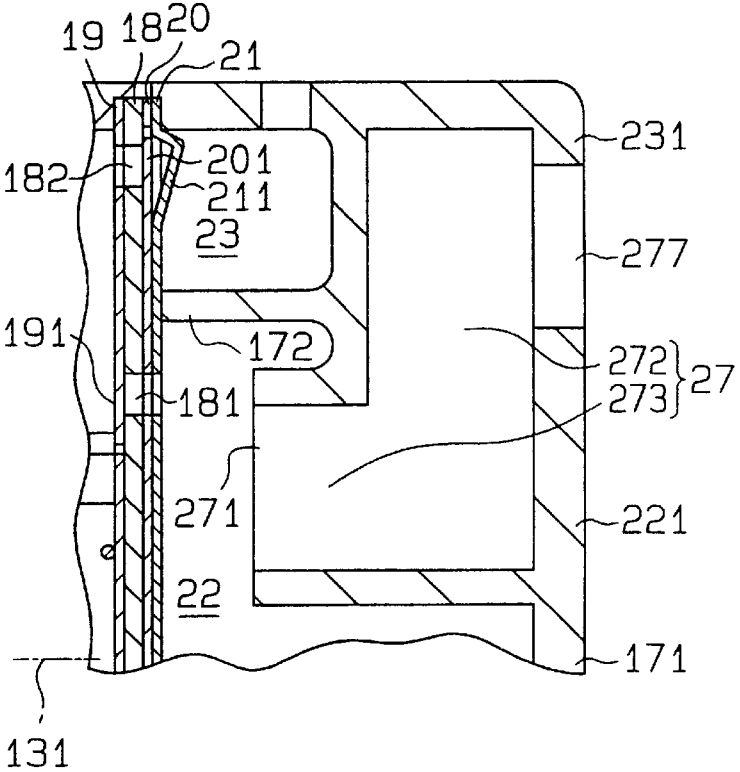
FIG. 7 is an enlarged partial sectional view in the vicinity of a suction chamber according to the fifth embodiment.

Next, a fifth embodiment, which is shown in FIG. 7, will be described. Parts that are the same as those in the first embodiment of FIGS. 1 to 3 are denoted by the same reference numerals used in the first embodiment.

An inlet 277 of the introduction passage 27 is formed in the end wall 231 of the discharge chamber 23. Therefore, the introduction passage 27 is bent at two locations. The larger the number bends, the greater the suppression of suction pulsation in the introduction passage 27 is.

What is claimed is:

1. A compressor comprising:

a housing having an opening portion, wherein the housing includes a cylinder block;

a rotary shaft supported by the housing;

a plurality of cylinder bores provided at constant angular intervals around the axis of the rotary shaft;

a discharge chamber formed in the housing;

a suction chamber formed in the housing;

a valve plate, which separates each cylinder bore from the suction chamber and from the discharge chamber, wherein a plurality of suction ports and a plurality of discharge ports corresponding to the respective cylinder bores are formed in the valve plate;

a piston accommodated in each cylinder bore, wherein the piston compresses gas drawn through the suction port into the cylinder bore and discharges the compressed gas from the cylinder bore into the discharge chamber through the discharge port; and an introduction passage, which extends from the opening portion of the housing toward the suction chamber, bends, and then extends toward the valve plate, wherein the introduction passage connects the opening portion of the housing with the suction chamber and conducts gas, and wherein the introduction passage has an outlet, which opens into the suction chamber, wherein the introduction passage is bent between the opening portion of the housing and the outlet.

2. The compressor of claim 1, wherein the bend in the introduction passage is disposed in the suction chamber.

3. The compressor according to claim 2, wherein the bend in the introduction passage is substantially perpendicular, and a section of the introduction passage is substantially parallel to the axis of the rotary shaft.

4. The compressor according to claim 3, wherein the suction chamber has a rear wall, which faces the valve plate, and the introduction passage has an exit opening, and the exit opening is closer to the valve plate than to the rear wall.

5. The compressor according to claim 3, wherein the discharge chamber and the suction chamber have rear walls that face the valve plate, and an upstream section of the introduction passage extends along the rear walls, and a downstream section of the introduction passage extends toward the valve plate.

6. The compressor according to claim 5, wherein an auxiliary suction chamber is located in the upstream section.

7. The compressor according to claim 1, wherein the suction chamber has a rear wall, which faces the valve plate, and the introduction passage has an exit opening, and the exit opening is closer to the valve plate than to the rear wall.

8. The compressor according to claim 1, wherein the discharge chamber and the suction chamber have rear walls that face the valve plate, and an upstream section of the introduction passage extends along the rear walls, and a downstream section of the introduction passage extends toward the valve plate.

9. The compressor according to claim 8, wherein an auxiliary suction chamber is located in the upstream section.

10. The compressor according to claim 1, wherein a part of the housing defines the introduction passage.

11. A compressor comprising:

a housing, wherein the housing includes:
an inlet opening;
a cylinder block;
a discharge chamber;
a suction chamber;

a rotary shaft supported by the housing;

a plurality of cylinder bores, which are formed in the cylinder block at equal angular positions about the axis of the rotary shaft;

a valve plate, which separates each cylinder bore from the suction chamber and from the discharge chamber, wherein a plurality of suction ports and discharge ports, each of which corresponds to one of the cylinder bores, are formed;

a plurality of pistons, which are located in the cylinder bores, respectively, wherein each piston compresses gas drawn from the suction chamber into the associated cylinder bore and discharges the compressed gas to the discharge chamber;

an introduction passage, which conducts gas into the suction chamber and which extends from the inlet opening to the suction chamber, wherein a bend is formed in the introduction passage between an upstream section and a downstream section of the passage.

12. The compressor of claim 11, wherein the bend is located in the suction chamber.

13. The compressor according to claim 12, wherein the bend is substantially perpendicular, and the downstream section of the introduction passage is substantially parallel to the axis of the rotary shaft.

14. The compressor according to claim 13, wherein the suction chamber has a rear wall, which faces the valve plate, and the introduction passage has an exit opening, and the exit opening is closer to the valve plate than to the rear wall.

15. The compressor according to claim 13, wherein the discharge chamber and the suction chamber have rear walls that face the valve plate, and the upstream section of the introduction passage extends along the rear walls, and the downstream section of the introduction passage extends toward the valve plate.

16. The compressor according to claim 15, wherein an auxiliary suction chamber is located in the upstream section.

17. The compressor according to claim 11, wherein the suction chamber has a rear wall, which faces the valve plate, and the introduction passage has an exit opening, and the exit opening is closer to the valve plate than to the rear wall.

18. The compressor according to claim 11, wherein the discharge chamber and the suction chamber have rear walls that face the valve plate, and the upstream section of the introduction passage extends along the rear walls, and the downstream section of the introduction passage extends toward the valve plate.

19. The compressor according to claim 18, wherein an auxiliary suction chamber is located in the upstream section.

20. The compressor of claim 11, wherein the upstream section extends in a generally radial direction of the rotary shaft and the downstream section extends in a generally axial direction of the rotary shaft.

21. The compressor according to claim 11, wherein a part of the housing defines the introduction passage.

22. A compressor comprising:

a housing, wherein the housing includes:
an inlet opening;
a cylinder block;
a discharge chamber;
a suction chamber;

a rotary shaft supported by the housing;

a plurality of cylinder bores, which are formed in the cylinder block at equal angular positions about the axis of the rotary shaft;

a valve plate, which separates each cylinder bore from the suction chamber and from the discharge chamber, wherein a plurality of suction ports and discharge ports, each of which corresponds to one of the cylinder bores, are formed;

a plurality of pistons, which are located in the cylinder bores, respectively, wherein each piston compresses gas drawn into the associated cylinder bore from the suction chamber and discharges the compressed gas to the discharge chamber;

an introduction passage, which conducts gas into the suction chamber and which extends from the inlet opening to the suction chamber, wherein a bend is formed in the introduction passage between an upstream section and a downstream section of the passage, and the downstream section extends toward the valve plate.

23. The compressor according to claim 22, wherein a part of the housing defines the introduction passage.

* * * * *

UNITED STATES PATENT AND TRADEMARK OFFICE

CERTIFICATE OF CORRECTION

PATENT NO. : 6,579,071 B1
DATED : June 17, 2003
INVENTOR(S) : Tomoji Tarutani et al.

It is certified that error appears in the above-identified patent and that said Letters Patent is hereby corrected as shown below:

Title page,
Item [56], References Cited, FOREIGN PATENT DOCUMENTS, please delete "65-56583" and insert therefor -- 64-56583 --

Signed and Sealed this

Seventh Day of October, 2003

JAMES E. ROGAN
*Director of the United States Patent and Trademark Office*